US011253423B1

(12) United States Patent
Williams et al.

(10) Patent No.: US 11,253,423 B1
(45) Date of Patent: Feb. 22, 2022

(54) VARIABLE STROKE PERCUSSIVE MASSAGE DEVICE

(71) Applicant: PlayMakar Inc., Fort Worth, TX (US)

(72) Inventors: Michael James Williams, Colleyville, TX (US); Wesley A. Coleman, N. Richland Hills, TX (US); Federico G. Vierheller, Fort Worth, TX (US)

( * ) Notice: Subject to any disclaimer, the term of this patent is extended or adjusted under 35 U.S.C. 154(b) by 0 days.

(21) Appl. No.: 17/229,860

(22) Filed: Apr. 13, 2021

Related U.S. Application Data

(60) Provisional application No. 63/120,502, filed on Dec. 2, 2020.

(51) Int. Cl.
*A61H 23/00* (2006.01)
*A61H 23/02* (2006.01)

(52) U.S. Cl.
CPC ..... *A61H 23/006* (2013.01); *A61H 23/0254* (2013.01); *A61H 2201/0153* (2013.01); *A61H 2201/149* (2013.01); *A61H 2201/1418* (2013.01); *A61H 2201/5025* (2013.01)

(58) Field of Classification Search
CPC ..... A61H 23/006; A61H 23/0254; A61H 2201/0153; A61H 2201/1418; A61H 2201/149; A61H 2201/5025
See application file for complete search history.

(56) References Cited

U.S. PATENT DOCUMENTS 4,088,128 A 5/1978 Mabuchi
4,513,737 A 4/1985 Mabuchi
4,549,535 A 10/1985 Wing
4,726,430 A 2/1988 Hendrikx et al.
4,790,296 A 12/1988 Segal
4,841,955 A 6/1989 Evans et al.
5,085,207 A * 2/1992 Fiore ..... A61H 7/005 601/103
5,656,017 A 8/1997 Keller et al.
6,228,042 B1 5/2001 Dungan
6,357,125 B1 * 3/2002 Feldmann ..... B23D 51/16 30/277.4
6,616,621 B1 9/2003 Kohr
6,682,496 B1 1/2004 Pivaroff
8,826,547 B2 9/2014 Oberheim
9,889,066 B2 2/2018 Danby et al.
(Continued)

FOREIGN PATENT DOCUMENTS

CN 2694966 Y 4/2005
CN 202536467 U 11/2012
(Continued)

*Primary Examiner* — Timothy A Stanis
*Assistant Examiner* — Matthew R Moon

(57) ABSTRACT

An adjustable stroke percussion massage device includes a stroke arm having a first end connected to a percussion massage head. A pin extends outward at a second end of the stroke arm. A cam has a cam slot formed into the cam such that the pin fits into the cam slot. The cam slot has a length, where the pin is movable from a first end of the cam slot to a second end of the cam slot, where the pin is a first distance from a rotation axis of the cam when positioned at the first end of the cam slot, and the pin is a second distance from the rotation axis of the cam when positioned at the second end of the cam slot. A motor is operable to rotate the cam about the rotation axis, moving the stroke arm along a vibration axis.

14 Claims, 5 Drawing Sheets

(56) References Cited

U.S. PATENT DOCUMENTS

| | | | | |
|---|---|---|---|---|
| 10,314,762 | B1 | 6/2019 | Marton et al. | |
| 10,357,425 | B2 | 7/2019 | Wersland et al. | |
| 10,492,984 | B2 | 12/2019 | Marton et al. | |
| 10,561,574 | B1 | 2/2020 | Marton et al. | |
| 10,702,448 | B2 | 7/2020 | Wersland et al. | |
| 10,993,874 | B1 | 5/2021 | Marton et al. | |
| 2005/0109137 | A1* | 5/2005 | Hartmann | B23D 51/16 74/25 |
| 2006/0293711 | A1 | 12/2006 | Keller et al. | |
| 2009/0270915 | A1 | 10/2009 | Tsai et al. | |
| 2014/0031866 | A1 | 1/2014 | Fuhr et al. | |
| 2015/0005682 | A1* | 1/2015 | Danby | A61H 23/0254 601/101 |
| 2015/0107383 | A1 | 4/2015 | Duesselberg et al. | |
| 2015/0182415 | A1 | 7/2015 | Olkowski et al. | |
| 2016/0354277 | A1 | 12/2016 | Fima | |
| 2018/0008512 | A1 | 1/2018 | Goldstein | |
| 2018/0168913 | A1 | 6/2018 | Sedic | |
| 2018/0200141 | A1 | 7/2018 | Wersland et al. | |
| 2018/0263845 | A1 | 9/2018 | Wersland et al. | |
| 2019/0209424 | A1 | 7/2019 | Wersland et al. | |
| 2019/0254921 | A1 | 8/2019 | Marton et al. | |
| 2020/0261307 | A1 | 8/2020 | Wersland et al. | |
| 2020/0261310 | A1 | 8/2020 | Wersland et al. | |
| 2020/0276079 | A1 | 9/2020 | Cheng | |
| 2020/0289365 | A1 | 9/2020 | Wersland et al. | |
| 2020/0330321 | A1 | 10/2020 | Wersland et al. | |
| 2020/0352820 | A1 | 11/2020 | Nazarian et al. | |
| 2020/0352821 | A1 | 11/2020 | Wersland et al. | |
| 2020/0405574 | A1* | 12/2020 | Wersland | A61H 1/008 |
| 2021/0322257 | A1* | 10/2021 | Lee | A61H 23/02 |

FOREIGN PATENT DOCUMENTS

| | | | |
|---|---|---|---|
| CN | 205268525 | U | 6/2016 |
| CN | 206381369 | U | 8/2017 |
| CN | 208130157 | U | 11/2018 |
| TW | M543692 | U | 6/2017 |

* cited by examiner

VARIABLE STROKE PERCUSSIVE MASSAGE DEVICE

CROSS-REFERENCE TO RELATED APPLICATIONS

This application claims the benefit of U.S. Provisional Patent Application 63/120,502, filed on Dec. 2, 2020, and is incorporated herein by reference.

STATEMENT REGARDING FEDERALLY SPONSORED RESEARCH AND DEVELOPMENT

Not Applicable.

FIELD OF THE INVENTION

This invention relates to percussion massagers, and more specifically, to a variable stroke percussive massage device configured as a handheld device that delivers a barrage of short rapid adjustable strokes that penetrate deeper into the muscle tissue.

BACKGROUND

Percussion massage devices have become increasing popular for home use. Typical percussion massage devices have a massage head that moves back and forth between an extended position and a retracted position. Typically, this distance can range from about 10 mm to about 20 mm and is referred to as the device's stroke length. This movement may occur as a rapid frequency, such as between about 1700 to about 3400 strokes per minute.

Conventional percussion massage devices have a fixed stroke length, albeit this fixed stroke length can vary from one device to another. Thus, if a user desires a gentler massage (with a shorter stroke length) on one day and a more vigorous massage (with a longer stroke length) on another day, they typically need to own two different percussion massage devices.

Therefore, there is a need for a device that can provide a user percussive massage therapy while allowing a user to change the stroke length in a simple and quick manner. The present invention accomplishes these objectives.

SUMMARY OF THE INVENTION

The present device, in exemplary embodiments, is adjustable stroke percussion massage device, comprising a stroke arm having a first end connected to a percussion massage head at a pivot joint, permitting the stroke arm to pivot from side-to-side relative to the percussion massage head. A pin can extend outward at a second end of the stroke arm. A cam has a cam slot formed into the cam such that the pin fits into the cam slot. The cam slot has a length, where the pin is movable from a first end of the cam slot to a second end of the cam slot, where the pin is a first distance from a rotation axis of the cam when positioned at the first end of the cam slot, and the pin is a second distance from the rotation axis of the cam when positioned at the second end of the cam slot. A motor is operable to rotate the cam about the rotation axis. The motor can reverse direction to change the stroke distance along the vibration axis.

In some embodiments, the first distance is about 3 to about 7 mm and the second distance is from about 8 to about 12 mm, providing a stroke of the percussion massage head along a vibration axis from about 6 to about 14 mm when the pin is at the first end of the cam slot and a stroke from about 16 to about 24 mm when the pin is at the second end of the cam slot.

Aspects of the present invention can provide a percussion massage device that can provide the user with two different stroke lengths of the massage head. A single massage device can now be used to provided different intensities of percussion massage for the user. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
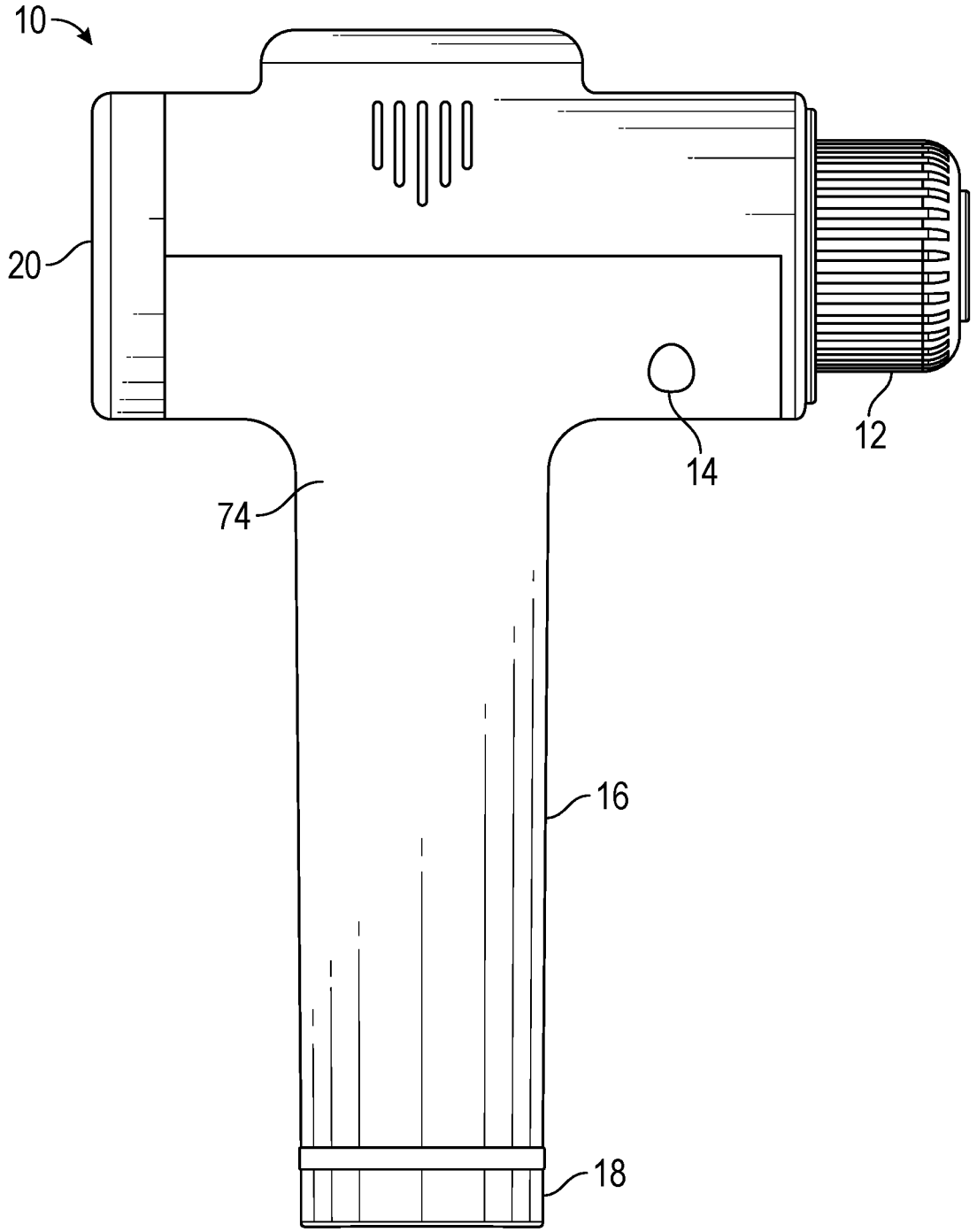
FIG. 1 is side view of a percussion massage device according to an exemplary embodiment of the present invention.
Figure 2:
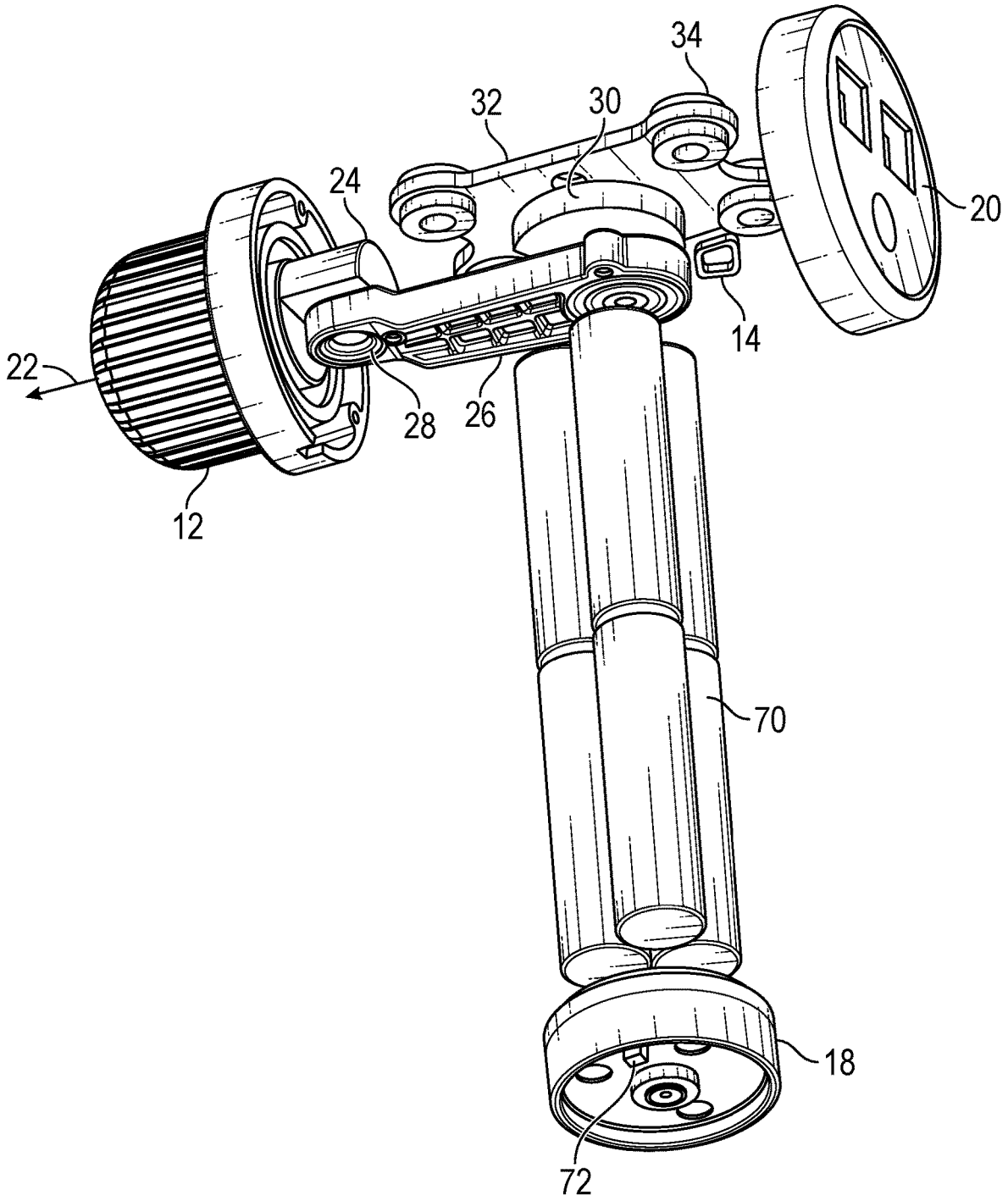
FIG. 2 is an exploded side perspective view of the percussion massage device of FIG. 1.
Figure 3:
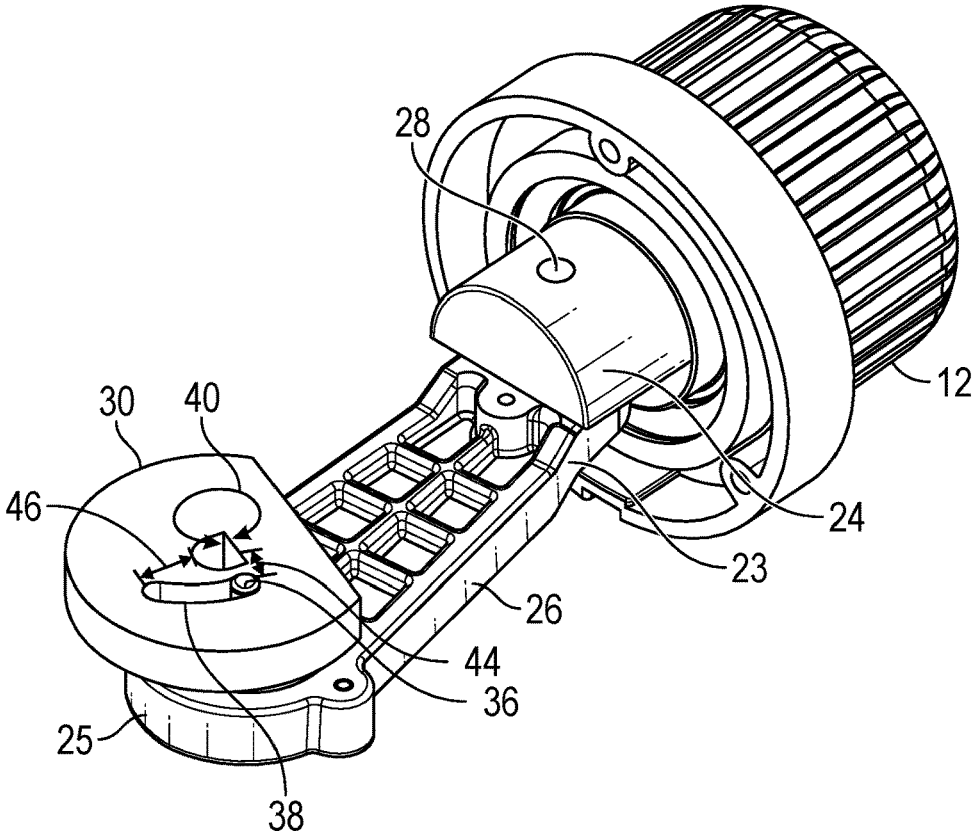
FIG. 3 is a detailed view of a stroke length adjustment cam and stroke arm for the percussion massage of FIG. 1.
Figure 4:
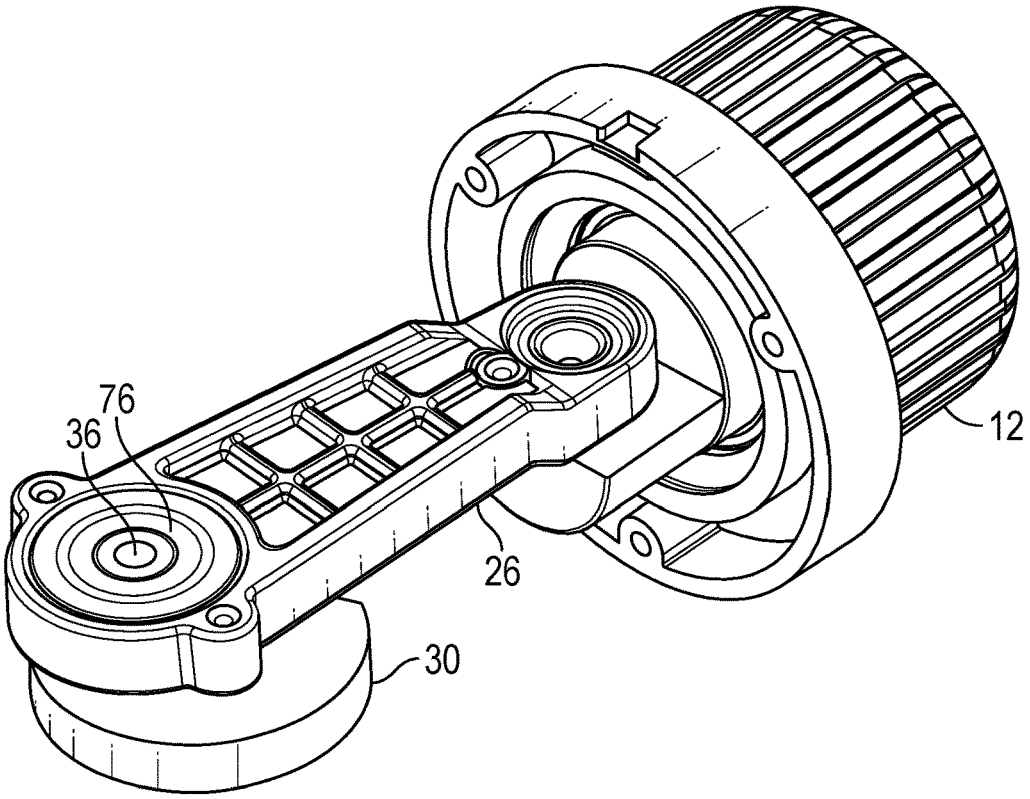
FIG. 4 is a bottom detailed view of the stroke length adjustment cam and stroke arm of FIG. 3.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

As discussed in greater detail below, an exemplary embodiment of the present invention is directed to a variable stroke percussive massage device which includes a spiral cam mechanism with a pin gear follower inserted in a traced groove with two ends at different distances from the center of rotation. These distances are variable and can be changed. When the motor shifts the direction of rotation, the pin engages at one of the two ends of the follower. The distance of travel is proportional to the groove's radial distance, from the axis to the cam. The cam can reverse directions to reset the position of the follower.

One object is to provide a variable stroke percussive massage device as a handheld device that delivers a barrage of short rapid adjustable strokes that penetrate deeper into the muscle tissue. Another object is to provide a variable stroke percussive massage device that delivers a short stroke (e.g., 10-14 mm) and a deep stroke (e.g., 14-24 mm). Another object is to provide a variable stroke percussive massage device that can rapidly and easily switch stroke lengths.

Referring to FIGS. 1 through 5, an adjustable stroke percussion massage device 10 includes a housing 74 generally forming a handle 16 with a massage head 12 extending, typically, at an angle to the handle 16. A display 20 can be provided in the housing 74 to provide an informational display to the user. The display 20 can include indicators of strokes per minute, battery life remaining, stroke length in the current direction, and the like.

Figure 5:
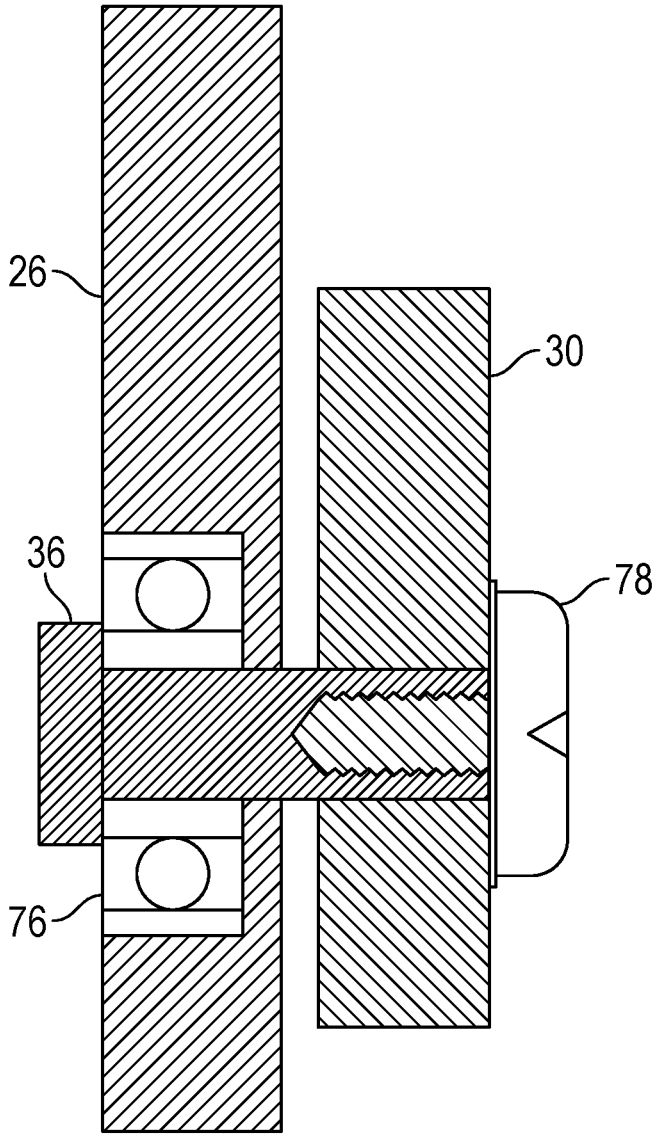
FIG. 5 is a detailed cross-sectional illustrating the cam to stroke arm connection of the percussion massage device of FIG. 1.

A stroke arm 26 can include a first end 23 connected to the percussion massage head 12 (also referred to as massage head 12 or simply head 12), via a massage head connector 24, at a pivot joint 28 to permit the stroke arm 26 to pivot from side-to-side relative to the percussion massage head 12. A pin 36 can extend outward at a second end 25 of the stroke arm 26. As shown in FIG. 5, one end of the pin 36 can connect to a bearing 76 disposed in the stroke arm 26. The other end of the pin 36 can attach to a screw 78 after passing through a cam slot 38 a cam 30, as described below. The screw 78 can prevent the cam 30 from separating away from the stroke arm 26 and ensure the pin 36 is engaged with the cam slot 38. Of course, other connections between the pin 36 and the cam slot 38 may be used to slidingly engage the pin 36 into the cam slot 38.

As described above, the cam 30 has a cam slot 38 formed into the cam 30 such that the pin 36 fits into the cam slot 38. The cam slot 38 has a length, where the pin 36 is movable from a first end of the cam slot 38 to a second end of the cam slot 38. The pin 36 is a first distance 44 from a rotation axis 40 of the cam 30 when positioned at the first end of the cam slot 38 and the pin 36 is a second distance 46 from the rotation axis 40 of the cam 30 when positioned at the second end of the cam slot 38.

A motor 50 is operable to rotate the cam 30 about the rotation axis 40. When the motor 50 turns in one direction, the pin may be at the first end of the cam slot 38, resulting in a first stroke length along the vibration axis 22 of the stroke arm 26. When the motor changes direction, the pin may be at the second end of the cam slot 38, resulting in a second stroke length, different from the first stroke length, along the vibration axis 22 of the stroke arm 26. A direction switch 14 may be provided on the housing 74 to allow the user to change direction of the motor 50.

The motor 50 can be mounted on a motor base 32 with a plurality of vibration dampers 34 disposed between the motor base 32 and the motor 50. Of course, various motor mount configurations may be used, provided that the motor 50 can turn the cam 30 about its rotation axis 40. For example, the cam 30 may include a shaft opening 42 located at the rotation axis 40, where a shaft (not shown) from the motor 50 can fit into the shaft opening 42 to rotate the cam 30. Of course, other motor mounting may be used, provided that the motor can rotate the cam 30 about its rotation axis 40.

In some embodiments, the first distance 44 is about 3 to about 7 mm and the second distance 46 is from about 8 to about 12 mm, providing a stroke length of the percussion massage head 12 along a vibration axis 22 from about 6 to about 14 mm when the pin 36 is at the first end of the cam slot 38 and a stroke length from about 16 to about 24 mm when the pin 36 is at the second end of the cam slot 38. In some embodiments, the cam 30 may be user replaceable, where the cam slot 38 in a replacement one of the cams is different from the installed cam, thus allowing the user to further adjust the stroke length.

In some embodiments, the cam slot 38 is arc shaped with a radius of curvature greater than a radius of curvature of the cam 30 during rotation thereof. In other embodiments, the cam slot 38 is linearly disposed adjacent an opening where a shaft providing the axis of rotation 40 of the cam 30.

The device 10 can be powered, for example, by batteries 70 disposed in the handle 16 formed from the housing 74. A power switch 72 can be formed in the housing 74, for example, at a removable bottom member 18 of the handle 16. The power switch 72 is configured to selectively supply or disconnect power from the batteries 70 to a motor 50. The bottom member 18 can further include a charge port for charging the batteries 70. In some embodiments, the batteries 70 may be removable and replaceable via the removable bottom member 18.

Figure 6:
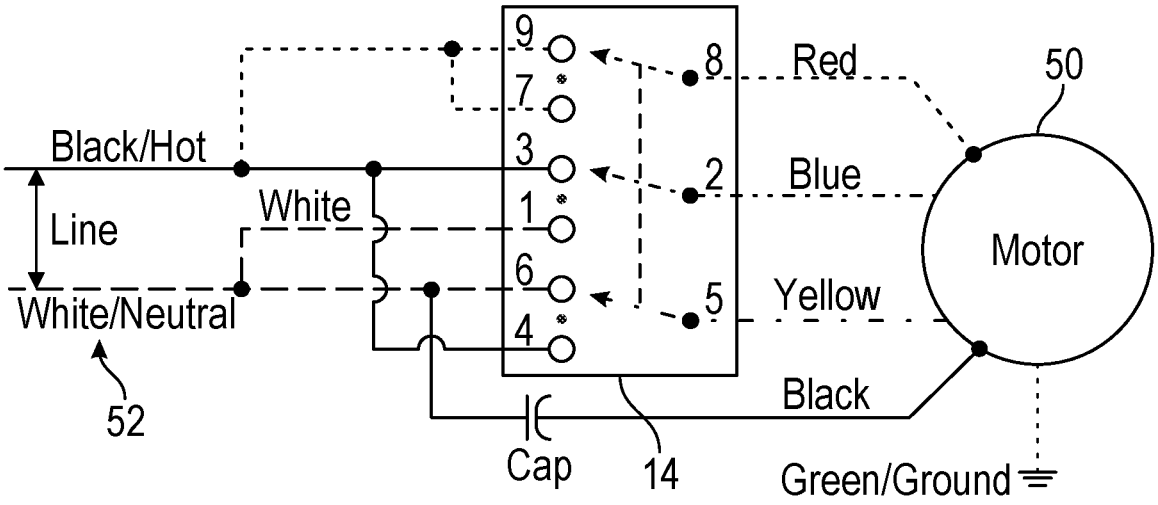
FIG. 6 is an exemplary wiring schematic for a switch to change the direction of the motor of the percussion massage device of FIG. 1.

Referring to FIG. 6, power 52 from the batteries can pass through the switch 14, which may be a triple pole, double throw switch, as illustrated. The switch 14 can be used, as described above, to change direction of the motor 50. In some embodiments, the switch may be a momentary switch, where depressing the switch can change the motor direction and removing a user's fingers from the switch can revert the motor back to its first direction. Such a switch may be useful to allow the more vigorous (greater stroke length) massage only while the switch is depressed, where a more gentle massage is the default action. Of course, different types of switches or different motor wiring schemes may be used, provided that the switch 14 can be used to change the direction of the motor 50.

While a particular form of the invention has been illustrated and described, it will be apparent that various modifications can be made without departing from the spirit and scope of the invention. For example, the percussion massage device may have a speed selector to adjust the number of strokes per minute of the massage head using conventional motor speed control technologies. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An adjustable stroke percussion massage device, comprising:

a stroke arm having a first end connected to a percussion massage head, wherein the stroke arm causes the percussion massage head to move along an axis of motion in accordance with a predetermined stroke length range;

a pin having a first end attached at a second end of the stroke arm and extending outward therefrom;

a cam having a cam slot formed into the cam such that the pin fits into the cam slot and is slidably engaged therewith by a screw attached at a second end of the pin, the cam slot having a length, the pin movable from a first end of the cam slot to a second end of the cam slot in accordance with a direction of rotation of the cam, where the pin is a first distance from a rotation axis of the cam when positioned at the first end of the cam slot and the pin is a second distance from the rotation axis of the cam when positioned at the second end of the cam slot;

further wherein the predetermined stroke length range is in a first stroke length range when the pin is the first distance from the rotation axis of the cam and in a second stroke length range when the pin is the second distance from the rotation axis of the cam; and a motor operable to rotate the cam in both directions about the rotation axis.

2. The adjustable stroke percussion massage device of claim 1, wherein the first distance is about 3 to about 7 mm and the second distance is from about 8 to about 12 mm, providing a predetermined stroke length of the percussion massage head along the axis of motion in a first length range from about 6 to about 14 mm when the pin is at the first end of the cam slot and a predetermined stroke length in a second length range from about 16 to about 24 mm when the pin is at the second end of the cam slot.

3. The adjustable stroke percussion massage device of claim 1, wherein the motor is a reversible direction motor.

4. The adjustable stroke percussion massage device of claim 3, wherein the cam slot is arc shaped with a radius of curvature greater than a radius of curvature of the cam during rotation thereof.

5. The adjustable stroke percussion massage device of claim 3, wherein the cam slot is linearly disposed adjacent to an opening where a shaft provides the axis of rotation of the cam.

6. The adjustable stroke percussion massage device of claim 1, further comprising a housing having the percussion massage head extending from one end thereof.

7. The adjustable stroke percussion massage device of claim 6, further comprising a direction switch on the housing, the direction switch operable to change a direction of rotation of the cam about the rotation axis via a motor.

8. The adjustable stroke percussion massage device of claim 6, further comprising batteries disposed in a handle formed from the housing.

9. The adjustable stroke percussion massage device of claim 6, further comprising a power switch formed in the housing, the power switch configured to selectively supply or disconnect power from batteries to a motor.

10. An adjustable stroke percussion massage device, comprising:

a stroke arm having a first end connected to a percussion massage head, wherein the stroke arm causes the percussion massage head to move along an axis of motion in accordance with a predetermined stroke length range;

a pin having a first end attached at a second end of the stroke arm and extending outward therefrom;

a cam having a cam slot formed into the cam such that the pin fits into the cam slot and is slidably engaged therewith by a screw attached at a second end of the pin, the cam slot having a length, the pin movable from a first end of the cam slot to a second end of the cam slot in accordance with a direction of rotation of the cam, where the pin is a first distance from a rotation axis of the cam when positioned at the first end of the cam slot and the pin is a second distance from the rotation axis of the cam when positioned at the second end of the cam slot;

a reversible direction motor operable to rotate the cam about the rotation axis, wherein changing a direction the reversible direction motor rotates around the rotation axis moves the pin automatically between the first end of the cam slot and the second end of the cam slot;

wherein the predetermined stroke length is in a first stroke length range when the pin is at the first end of the cam slot and in a second stroke length range when the pin is at the second end of the cam slot; and a direction switch operable to change a direction of the cam about the rotation axis by the reversible direction motor.

11. The adjustable stroke percussion massage device of claim 10, wherein the first distance is about 3 to about 7 mm and the second distance is from about 8 to about 12 mm, providing a predetermined stroke length of the percussion massage head along the axis of motion in a first length range from about 6 to about 14 mm when the pin is at the first end of the cam slot and a predetermined stroke length in a second length range from about 16 to about 24 mm when the pin is at the second end of the cam slot.

12. The adjustable stroke percussion massage device of claim 10, further comprising batteries disposed in a handle of the adjustable stroke percussion massage device.

13. The adjustable stroke percussion massage device of claim 10, further comprising a power switch configured to selectively supply or disconnect power from batteries to a reversible direction motor.

14. The adjustable stroke massage device of claim 10, wherein the percussion massage head is rotatable about one or more axes.

* * * * *